United States Patent [19]

Kunczynski

[11] Patent Number: 4,998,482

[45] Date of Patent: Mar. 12, 1991

[54] AERIAL TRAMWAY AND METHOD FOR RELIEVING INDUCED TORQUE

[75] Inventor: Jan K. Kunczynski, Glenbrook, Nev.

[73] Assignees: Zygmunt A. Kunczynski; Alexander J. Kunczynski, both of Carson City, Nev.

[21] Appl. No.: 470,864

[22] Filed: Jan. 26, 1990

[51] Int. Cl.[5] ..... B61B 7/04

[52] U.S. Cl. ..... 104/178; 104/112; 104/180

[58] Field of Search ..... 104/112, 117, 173.1, 104/178, 180, 184, 197, 202, 222, 224, 115; 105/163.2; 198/465.3, 803.2

[56] References Cited

U.S. PATENT DOCUMENTS

| | | | |
|---|---|---|---|
| 4,329,926 | 5/1982 | Sowder et al. | 104/197 |
| 4,608,930 | 9/1986 | Galmiche | 104/87 |
| 4,848,241 | 7/1989 | Kunczynski | 104/173.1 |
| 4,864,937 | 9/1989 | Kunczynski | 104/173.1 |

FOREIGN PATENT DOCUMENTS

| | | | |
|---|---|---|---|
| 0187552 | 7/1986 | European Pat. Off. | 104/180 |
| 0355084 | 2/1990 | European Pat. Off. | 104/178 |
| 0370389 | 4/1939 | Italy | 104/87 |
| 2097738 | 11/1982 | United Kingdom | 104/112 |

*Primary Examiner*—Robert P. Olszewsky
*Assistant Examiner*—Mark T. Le
*Attorney, Agent, or Firm*—Flehr, Hohbach, Test, Albritton & Herbert

[57] ABSTRACT

An aerial tramway having a pair of side-by-side, substantially parallel, movable haul ropes and at least one load carrying unit attached between the haul ropes for advancement therewith. A plurality of detachment assemblies are positioned periodically along the course of the haul rope to detach the load carrier from at least one of the haul ropes and thereby relieve torque induced in the load carrier due to differences in haul rope speeds. The load carrying units preferably have grip assemblies which wedge against the haul ropes, and detachment wheels lift the load carrier unit and grip assemblies up off the haul ropes to effect detachment. A method of conveying load carrying units by side-by-side haul ropes which prevents torque build-up in the units also is disclosed.

43 Claims, 8 Drawing Sheets

FIG._4
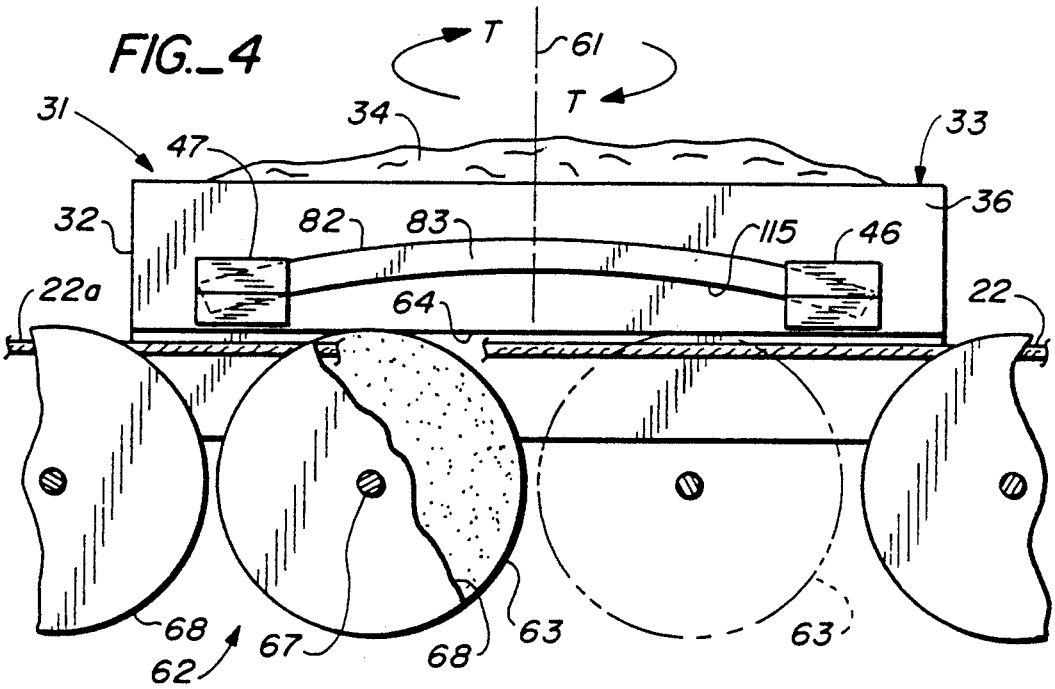
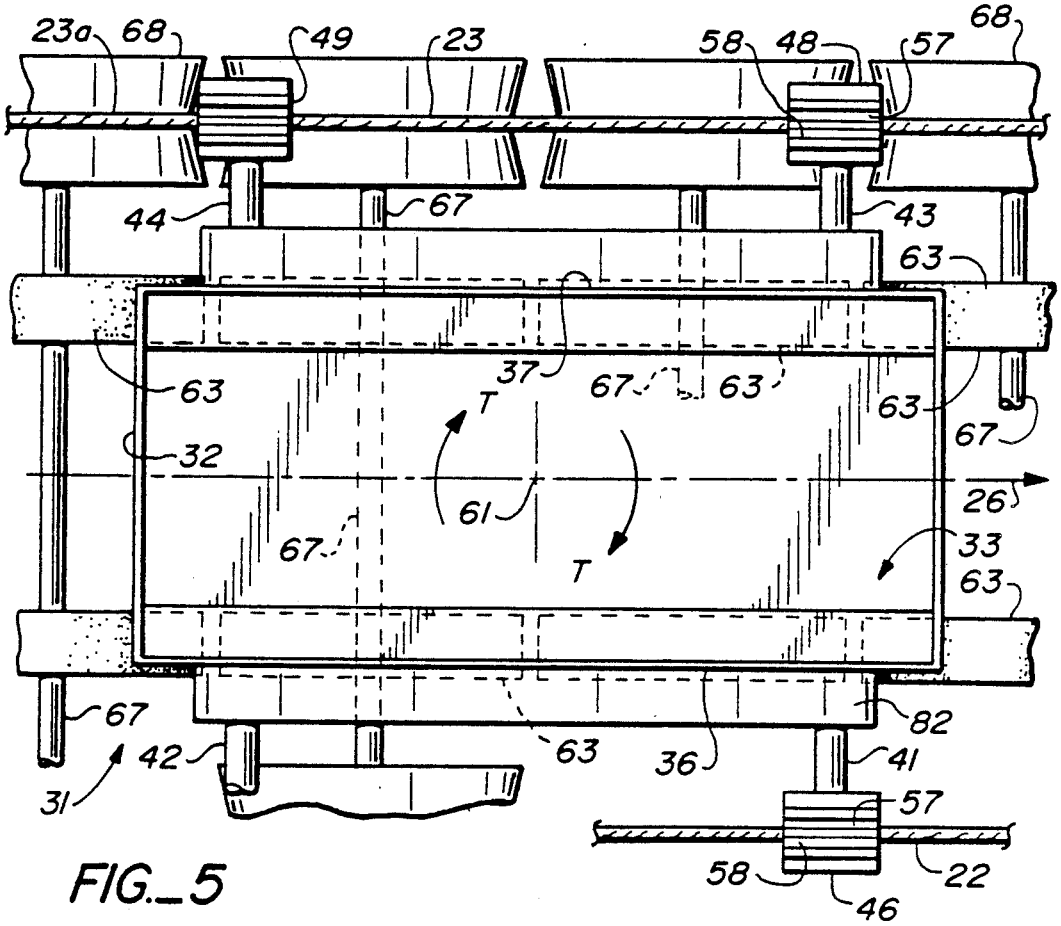
FIG._5

FIG._7
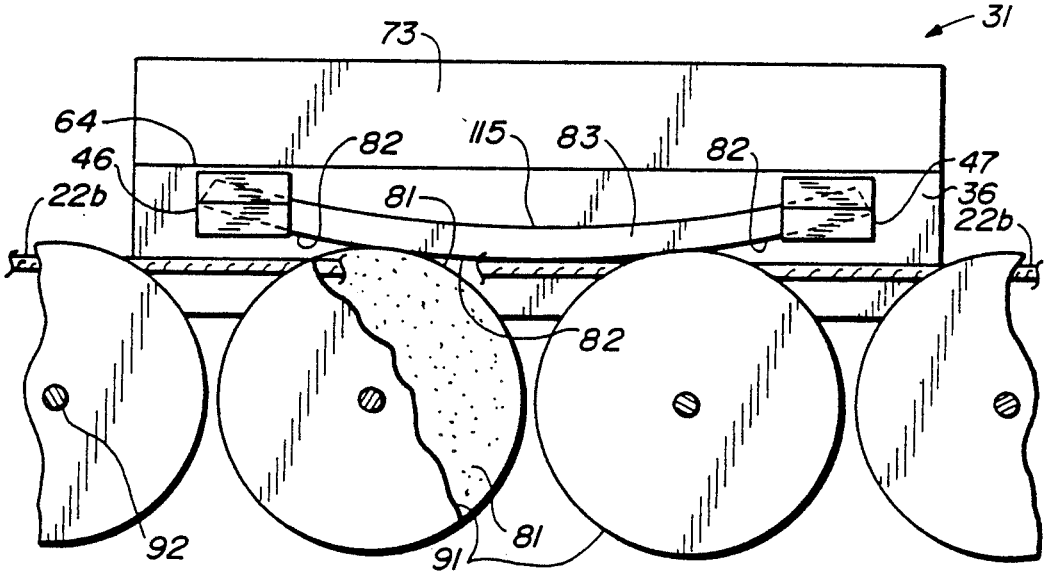
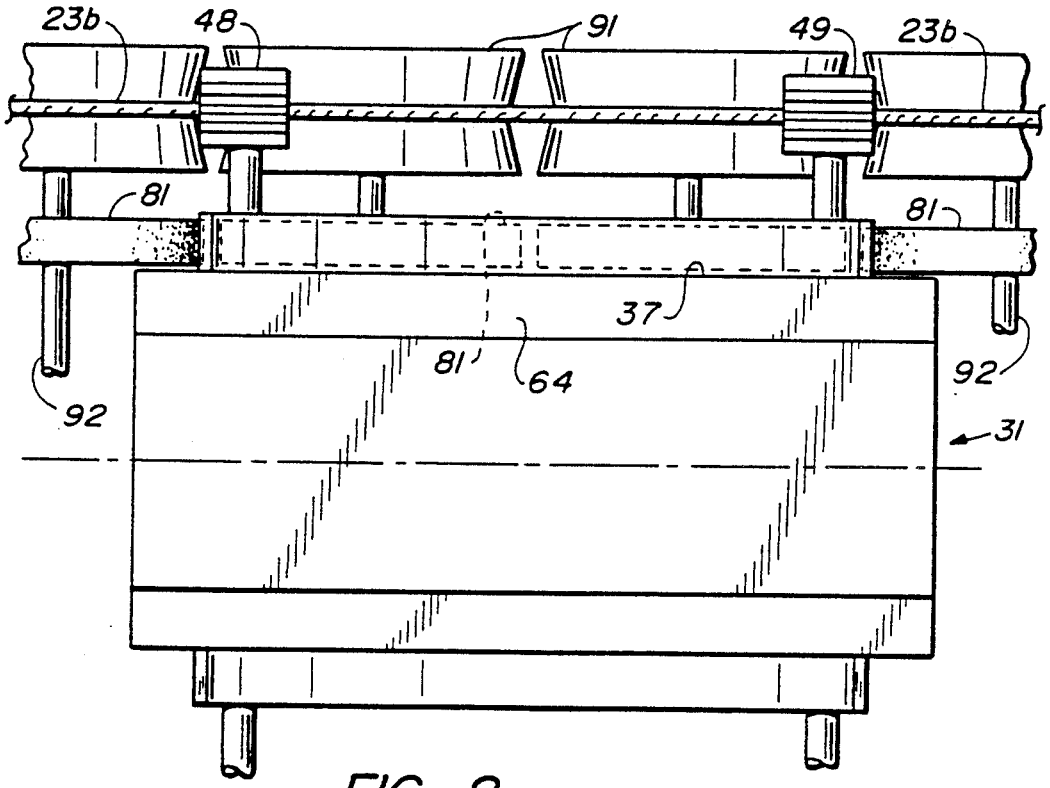
FIG._8

AERIAL TRAMWAY AND METHOD FOR RELIEVING INDUCED TORQUE

TECHNICAL FIELD

The present invention relates, in general, to aerial tramways or conveyors of the type used to carry loads, such as passengers and bulk loads, and more particularly, relates to aerial tramways in which a load carrying unit is attached between a pair of side-by-side haul ropes for advancement along a course.

BACKGROUND ART

In the mining industry ore is often conveyed over long distances by aerial tramways. Such aerial tramways typically include a plurality of load carrying units or buckets that are filled with ore and attached to a movable haul rope supported from towers which extend over the length of the course over which the ore is to be conveyed.

A typical prior art mining aerial tramway system includes pairs of stationary cables on which the load carrying buckets are mounted by means of rollers. The movable haul rope is connected to each bucket in between the stationary ropes. The buckets are rolled along the stationary ropes by driving the movable haul rope. This system has the disadvantage of requiring three ropes and, more importantly, requiring that each of the load carrying units be provided with sheave assemblies which roll on the stationary ropes. Such sheaves, however, are subject to substantial wear and tear, particularly in dusty and abrasive mining environments.

Aerial tramways are also extensively used in the recreational industry in connection with skiing. Such tramways typically employ a plurality of load carrying passenger units which are attached to a movable haul rope and conveyed over a relatively short distance, for example, one-half to one and one-half miles. While the passenger carrier units of recreational aerial tramways could be changed to ore carrying units, there are numerous differences in mining applications which make conventional passenger carrying aerial tramways not well suited for use in the transport of ore.

In mining applications, ore is often transported over much longer distances, e.g., five-to-twenty miles. Moreover, it is important to maximize the load which can be transported by the tramway, and the presence of substantial airborne dust and debris is extremely hard on equipment.

One approach to increasing the loading or capacity of aerial tramways is to couple the load carrying units of an aerial tramway to pairs of side-by-side, endless haul ropes, as for example is shown in my U.S. Pat. Nos. 4,848,241 and 4,864,937. In my U.S. Pat. No. 4,864,937 the load carrying unit is supported on both the top and bottom portions or stretches of the pairs of haul ropes, which further increases loading capacity, but which also requires the use of sheaves or roller elements on each carrier unit. In the dusty environment of mining and transportation of ore, it is desirable to minimize the number of roller elements or sheaves employed in the tramway system.

In my U.S. Pat. No. 4,848,241 I employ an aerial tramway system in which the load carrying units are detachably mounted to pairs of haul ropes and the speed of the haul ropes is maintained in synchronism by slightly adjusting the diameter of one of the haul rope bull or drive wheels. This approach is entirely adequate for aerial tramway systems designed for transport of passengers since the length of the tramway course is not excessive.

In mining applications, however, it is very difficult to maintain synchronism of two haul ropes over a course length of, for example, 15 miles, using adjustable bullwheels at the ends of the tramway. Moreover, differences in haul rope speed which seem extremely small will accumulate to produce substantial relative displacements of the haul ropes over long courses. As the relative rope displacement increases because of differing rope speeds, the load carrying unit is placed under an increasing torque, which can become very substantial and potentially destructive to grip assemblies and the structure of the load carrying unit itself. Using side-by-side haul ropes to increase loading capacity, therefore, presents significant problems when employed in an aerial tramway system of substantial length.

Accordingly, it is an object of the present invention to provide an aerial tramway system which is suitable for use in ore transport applications over extremely long courses.

Another object of the present invention is to provide an aerial tramway system which is capable of supporting and transporting heavy loads, operates reliably in dusty and debris-filled environments, and is suitable for use over long courses.

Still another object of the present invention is to provide a method for conveying load carrier units of the type used to transport ore which is reliable and economical in its operation and is capable of transporting ore over very long distances.

Still a further object of the present invention is to provide an aerial tramway system and method for operation of the same in which frictional losses over the length of a long course can be compensated for and loading and unloading of ore from the load carrying units can be efficiently accomplished.

Another object of the present invention is to provide an aerial tramway system which is durable, capable of substantial loads, employs haul ropes of moderate size, and uses cable gripping assemblies which have no moving parts.

The aerial tramway system and method of the present invention have other objects and features of advantage which will become apparent from, and are set forth in more detail in, the accompanying drawing and following description of the Best Mode 0f Carrying Out The Invention.

DISCLOSURE OF INVENTION

The present aerial tramway includes a pair of side-by-side, substantially parallel, movable haul ropes extending over a course, and at least one load carrying unit attached between the haul ropes for advancement with the haul ropes. The improvement in the aerial tramway of the present invention is comprised, briefly, of a plurality of detachment assemblies positioned periodically along the tramway course intermediate its ends with the detachment assemblies detaching the load carrier unit from at least one of the haul ropes efficiently to relieve torque induced in the load carrying unit due to differences in haul rope speeds and then permitting reattachment of the load carrying unit to the haul rope. In the preferred form, the load carrying unit is attached to the haul ropes by grip assemblies having no moving parts that are gravity biased to wedge into gripping engagement with the haul rope, and the detachment assemblies are provided by a plurality of support wheels or roller elements which lift the grip assembly or assemblies up off the haul rope on at least one, and preferably both, sides of the load carrying unit. The wheel assemblies also convey the load carrying unit as detached at about the speed of the haul rope and then allow the load carrying unit to drop back down and grips to become wedged on the haul ropes to reattach the load carrying unit for movement with the haul ropes. The attachment and reattachment can occur at haul rope support towers selected along the length of the tramway course to relieve torque before it builds to undesirable levels.

The method of the present invention comprises, briefly, the steps of attaching a load carrying unit to a pair of haul ropes, advancing the haul ropes over the course to advance the load carrying unit therewith, periodically, over the length of the course, detaching the load carrying unit from at least one of the haul rope to relieve torque induced in the load carrying unit as a result of differing haul rope speeds, and thereafter reattaching the carrier unit to the haul rope.

BRIEF DESCRIPTION OF THE DRAWING

FIG. 4 is a side elevation view, partially broken away and taken substantially along plane 4—4 in FIG. 3.

FIG. 5 is a top plan view, partially broken away, of the load carrier unit of FIG. 3 with the bulk load removed.

FIG. 7 is a side elevation view, partially broken away and taken substantially along the plane of line 7—7 in FIG. 6.

FIG. 8 is a top plan view of one half of the load carrier unit of FIG. 6 shown in an inverted position.

BEST MODE OF CARRYING OUT THE INVENTION

The aerial tramway system of the present invention is particularly well suited for the transportation of bulk particulate loads, such as mining ore. It will be understood, however, that some of these structures employed in the tramway system of the present invention are suitable for use in aerial tramways designed for passenger transportation.

Figure 1:
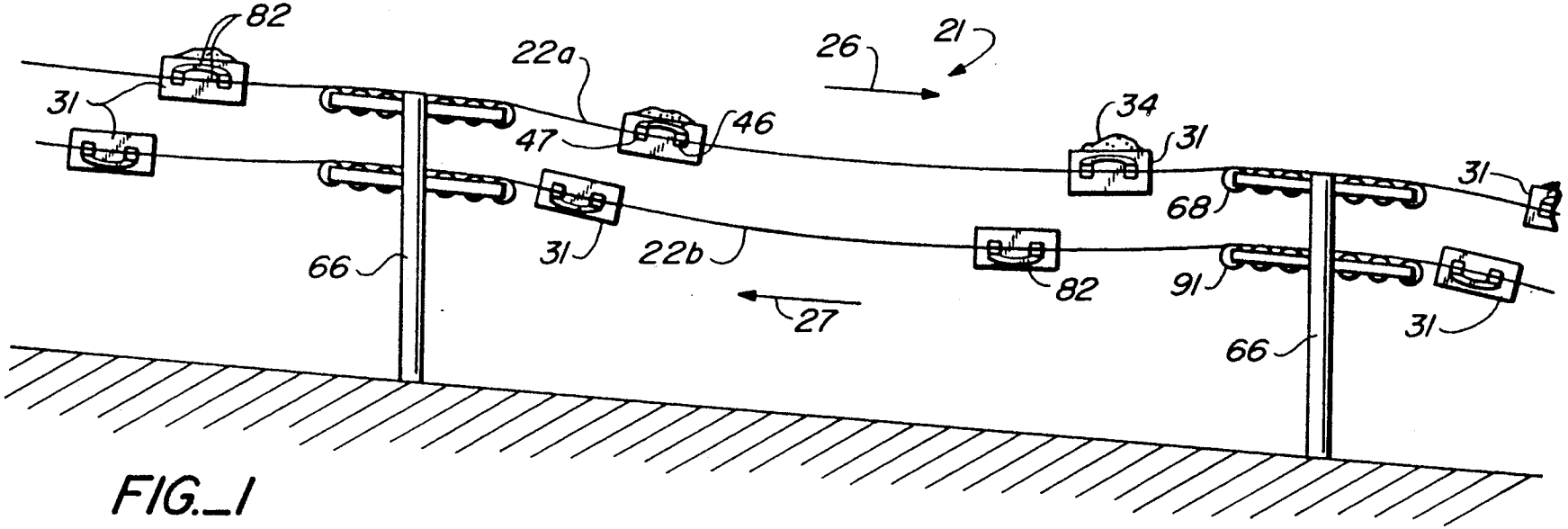
FIG. 1 is a side elevation view of an aerial tramway system constructed in accordance with the present invention.
Figure 2:
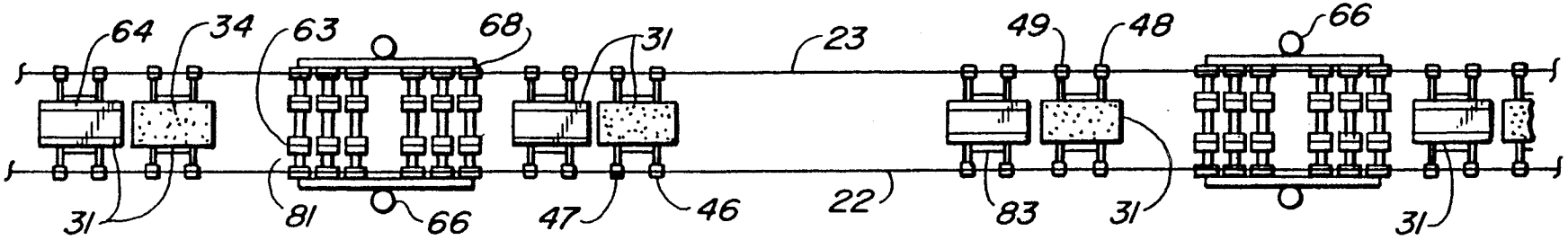
FIG. 2 is a top plan view of the aerial tramway system of FIG. 1.
Figure 9:
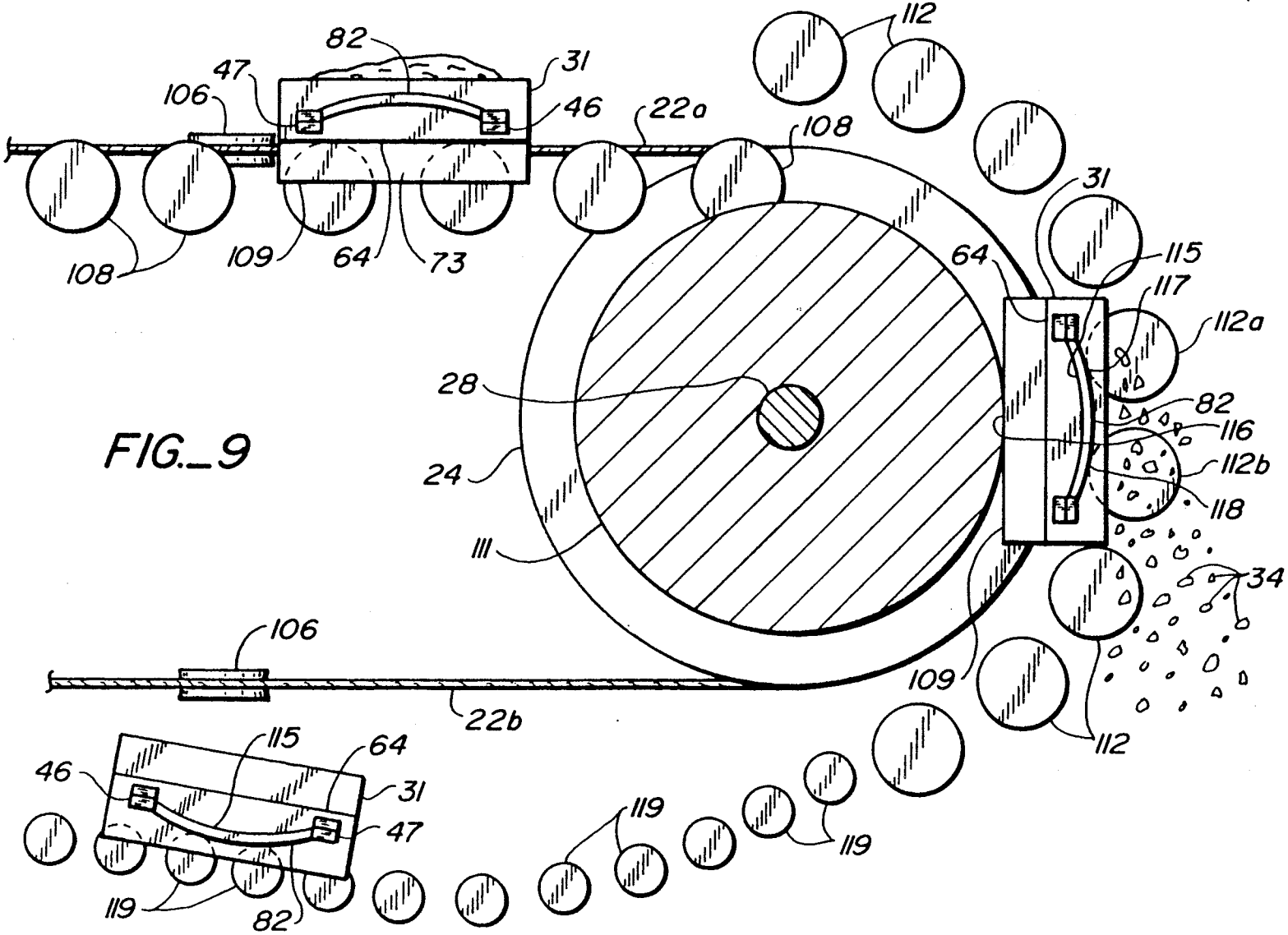
FIG. 9 is a side elevation, schematic view of an end terminal assembly of the type suitable for use with the aerial tramway system of FIG. 1.
Figure 10:
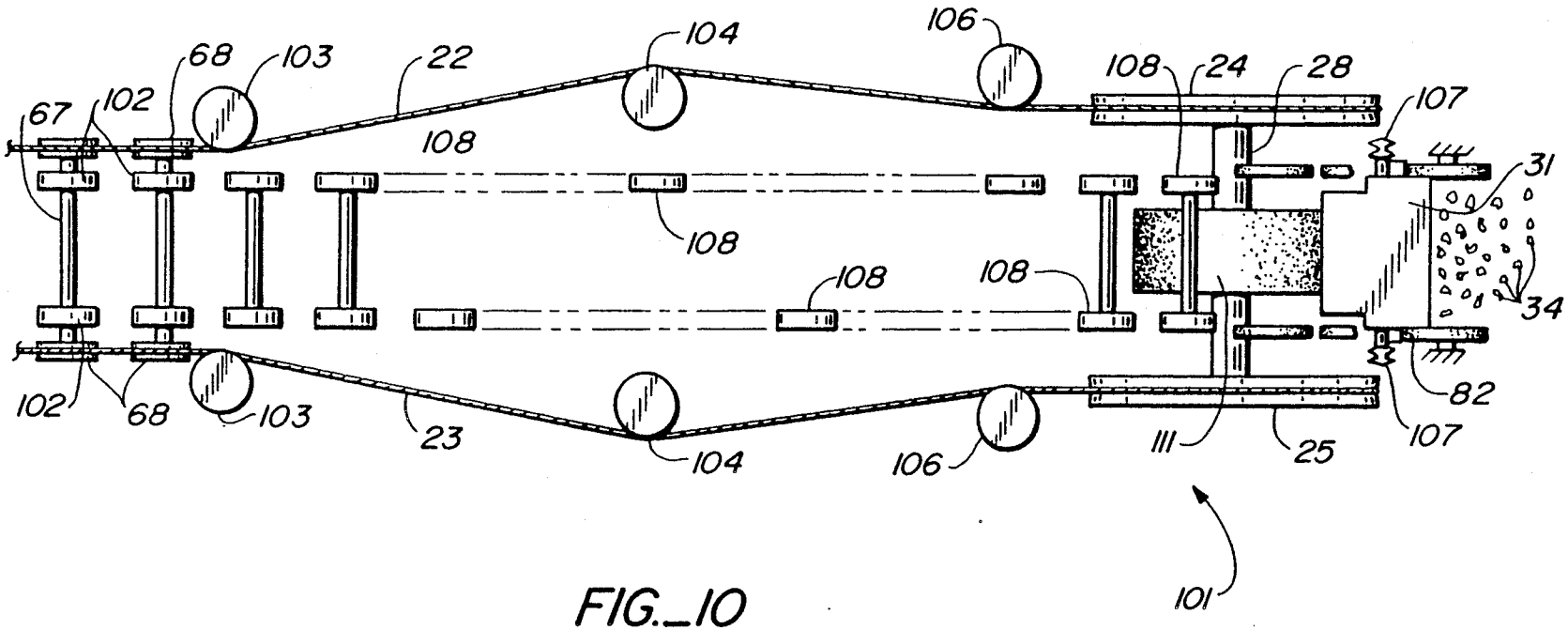
FIG. 10 is a top plan, schematic view, in reduced scale, of the end terminal of FIG. 9.

As may be seen in FIGS. 1 and 2, aerial tramway system 21 is based upon the use of two side-by-side, substantially parallel, endless-loop haul ropes 22 and 23. At each end of haul ropes 22 and 23 is a structure for reversing the haul ropes, such as vertical bullwheels 24 and 25 (FIGS. 9 and 10). Thus, haul rope 22 has an upper stretch or portion 22*a* traveling in the direction of arrow 26 and a lower stretch or portion 22*b* traveling in the direction of arrow 27. Haul rope 23 (FIG. 2) has similar upper and lower stretches 23*a* and 23*b* (FIGS. 3 and 6) traveling in the same directions as the corresponding stretches of haul rope 22. The two haul ropes 22 and 23 are driven by drive means at as close to the same speed as is reasonably possible. Most conveniently, two vertical bullwheels 24 and 25 of the same diameter can be driven by a common drive axle or shaft 28 (FIGS. 9 and 10) so that the haul rope speeds are essentially matched.

It should be noted, however, that in mining applications it is desirable to have the drive motors for the tramway remote of the dusty end terminals at which loading and unloading of the buckets or load carrying units occurs. Accordingly, bullwheels 24 and 25 may only be idler wheels used to reverse the haul rope direction of advancement with driving of the haul ropes taking place intermediate the end terminals, as will be experienced more fully hereinafter.

While the haul rope speeds in such tramway systems are "essentially" matched, they are not "exactly" matched so that load carrying units, such as units 31, attached between haul ropes 22 and 23 will gradually become skewed or torqued by the slightly differing haul rope speeds. If, for example, one of the vertical bullwheels 24 and 25 is even a tenthousandth of an inch in diameter different from the diameter of the other bullwheel, that difference will eventually accumulate over a long course to produce skewing or twisting of the load carrying units beyond what the grip and arm structures can tolerate.

This problem of differences between haul rope speeds when carrier units are secured to parallel, side-by-side haul ropes is addressed in my U.S. Pat. No. 4,848,241 by providing vertical bullwheels which are radially adjustable. Radial adjustment of the bullwheels can be accomplished while they are operating to insure synchronism between the side-by-side haul ropes. The tramway system of the present invention, as thus far described, uses the same basic structure as the aerial tramway of my U.S. Pat. No. 4,848,241, but instead of attempting to drive the haul ropes at exactly the same speed through the use of an adjustable drive means, the tramway system of the present invention is constructed so as to tolerate or accommodate slightly different haul rope speeds and to relieve the torque induced in the load carrier units by periodically detaching the load carrying units from, and reattaching them to, at least one of the two haul ropes.

Figure 3:
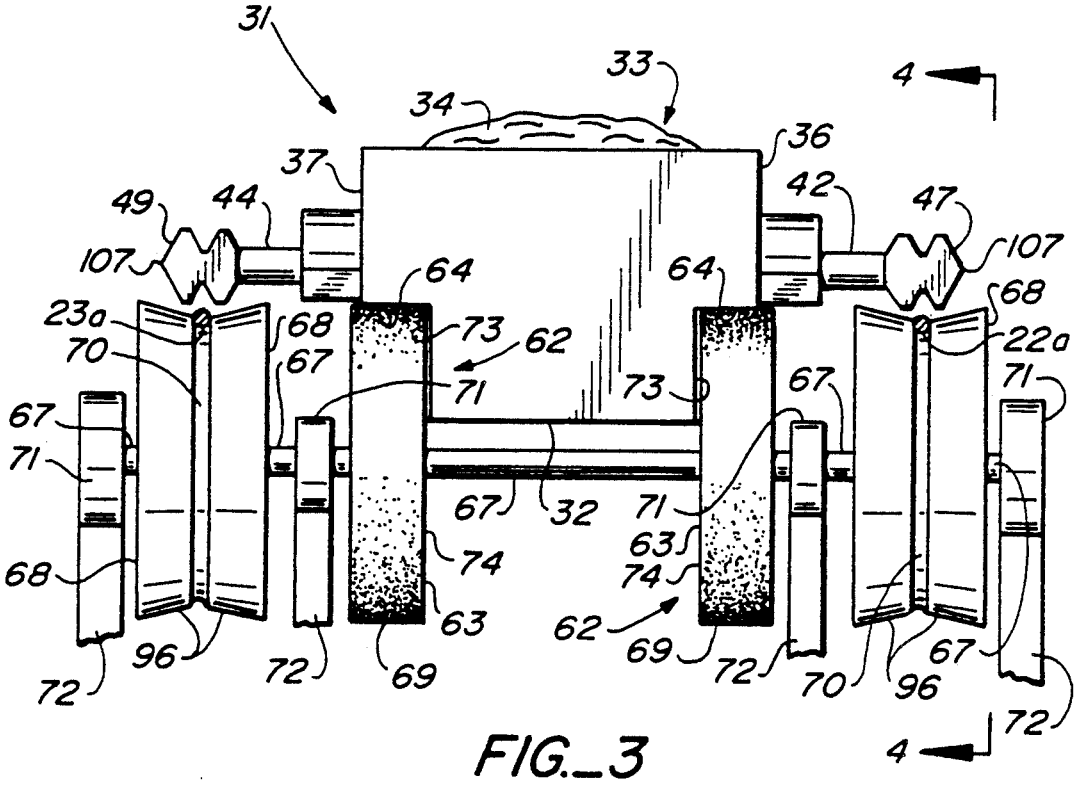
FIG. 3 is an enlarged, end elevation view of a load carrying unit which has been detached from the pair of haul ropes in the tramway system of FIG. 1.

As best may be seen in FIGS. 3, 4 and 5, load carrying units 31 can be formed with generally rectangular bodies 32 having an open top 33 for receipt of a bulk material, such as ore 34. Extending outwardly from opposite sides 36 and 37 of load carrying unit 31 are two pairs of longitudinally spaced apart arms. Arms 41 and 42 extend from side 36, while arms 43 and 44 extend from side 37 (FIG. 5). Mounted on the ends of arms 41–44 are grip assemblies 46, 47, 48 and 49.

Figure 6:
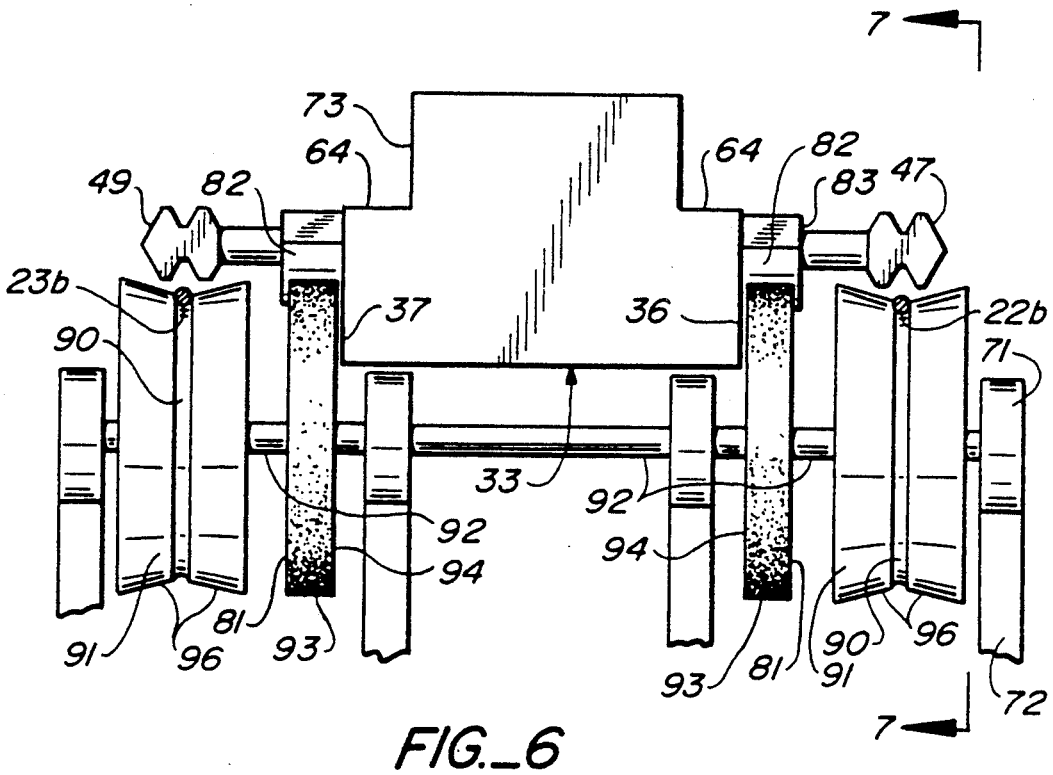
FIG. 6 is an end elevation view of the load carrier unit corresponding to FIG. 3 with the load carrying unit in an inverted and detached position.

In the preferred form of the aerial tramway system of the present invention, and in order to afford easy detachment and reattachment of the load carrying units to the haul ropes, grip assemblies 46–49 are formed for gravity wedging into gripping engagement with each of the haul ropes when load carrying unit 31 is in the upright position of FIGS. 3 through 5. Moreover, as will be described in more detail hereinafter, it is further preferable that each of grip assemblies 46 through 49 be formed for gravity wedging into gripping engagement with the haul ropes when the load carrying unit is inverted, as shown in FIGS. 6, 7 and 8.

Each of grip assemblies 46–49 can include a downwardly facing groove, generally designated 51 (FIG. 11), having a pair of converging gripping faces 52 and 53 which converge toward an apex 54 smaller in diameter than the diameter of the haul rope. The weight of the load carrier unit, and its load when filled, urges converging surfaces 52 and 53 down against the haul rope so as to wedge the same against the haul rope and effect gripping.

It is preferable that surfaces 52 and 53 converge at an angle from the vertical which is great enough to avoid self-locking or wedging into locking engagement of the grip assembly against the haul rope. Additionally, surfaces 52 and 53 cannot be at such a great angle from the vertical so as to provide wedging action which is insufficient to convey the load carrying units up or down grades which will be encountered over the course of the tramway. The angle, Θ, between the vertical and face 52 (FIG. 11) preferably is in the range of about 14 to about 25 degrees to achieve non-locking wedging with sufficient strength to transport load carrier units on grades of the type commonly encountered in the transport of ore. It should be noted that it would be possible, in extreme conditions, to tolerate some self-locking by wedge angles less than 14 degrees for the transport of ore on extremely steep slopes. When so used, detachment of the grip assemblies would be more difficult and may require engagement of both the rope and the load carrying unit to effect separation. Similarly, in near flat tramway installations, very little wedging action is required to maintain the position of the load carrying unit with respect to the haul rope, so that the wedge angle Θ can be greater than 25 degrees. In mining applications, for example, the exact spacing between load carrying units, within reason, is not very critical. Accordingly, some slippage along the haul ropes as a result of higher wedge angles can be tolerated.

In order to grip haul ropes 22 and 23 when carrier units 31 are inverted, it is preferable that each of the grip assemblies 46–49 also include an upwardly facing groove 56 with converging faces 57 and 58 constructed in the same manner as the downwardly facing groove 51.

One of the substantial advantages of employing a gravity-actuated wedging grip assembly as above described is that there are no moving parts. Thus, debris and dust, which is common in a mining operation and in ore transport, will not foul or impede wedging action of the cable gripping converging surfaces. It is possible, however, to employ other forms of detachable grip assemblies within the broad scope of the present invention, and in passenger transport applications, detachable grip assemblies which more positively grip the haul rope are desirable for enhanced safety.

As above described, if a load carrying unit 31 is attached to side-by-side haul ropes 22 and 23 for advancement down a tramway course, the inability to exactly match the speed of advancement of the two haul ropes will, with certainty over substantial lengths, begin to cause skewing or twisting of the passenger carrier unit about a vertical axis 61, as indicated by torque arrows T in FIGS. 5 and 6. Unless the wedge assemblies are released from the haul ropes, the torque about axis 26 will induce very high stress loads in wedge assemblies 46–49, arms 41–44 and body 32 of the load carrying unit. Over long course, this stress could cause failure of one or more of these components or skewing of the haul ropes in a manner which could produce derailment.

Figure 11:
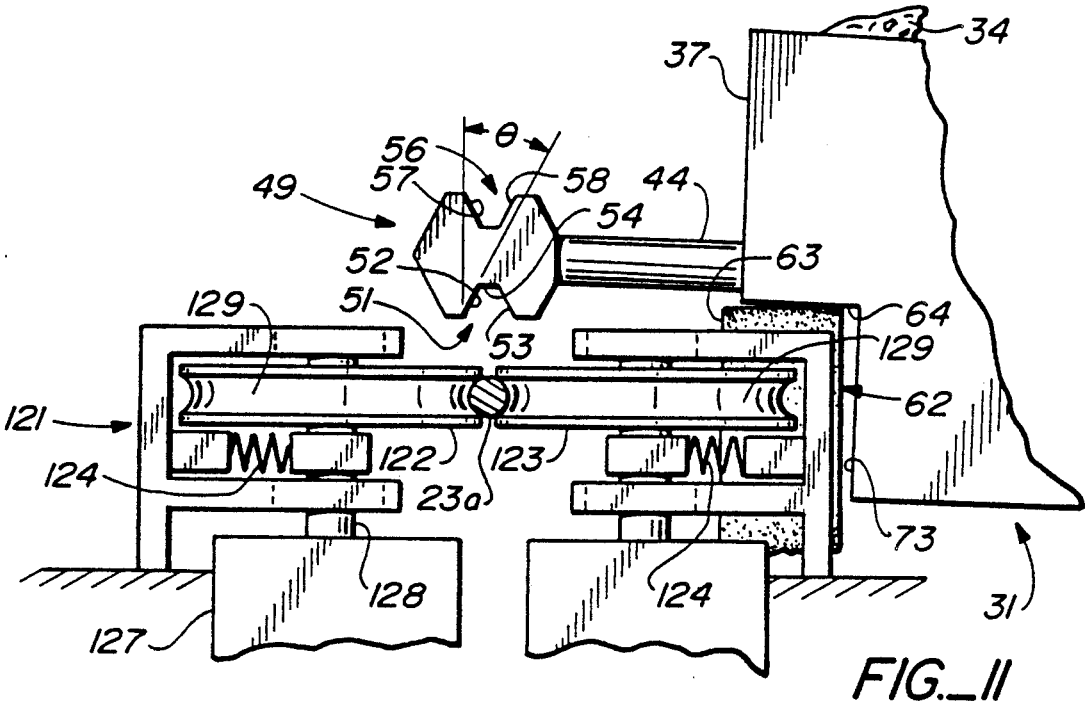
FIG. 11 is an enlarged, fragmentary, end elevation view of an auxiliary drive assembly suitable for use in the aerial tramway system of FIG. 1.

In the tramway system of the present invention, therefore, a plurality of detachment means, generally designated 62, are positioned periodically along the tramway course. Detachment means 62 detach load carrier units 31 from at least one of haul ropes 22 and 23 by an amount, and for a time, sufficient to relieve torque induced in the load carrier unit due to differences in haul rope speed. In the form of aerial tramway system illustrated in the drawing, detachment means 62 is provided by a plurality of wheels 63 which engage a surface, such as a longitudinally extending, downwardly facing, drive shoe surface 64 on the body of the bucket or load carrying unit. As shown in FIG. 11, detachment wheels 63 engage step drive shoe surface 64 along only one side, namely side 37 of the load carrying unit. Such engagement tilts the unit slightly and lifts wedging surfaces 52 and 53 in grips 48 and 49 off of haul rope 22. With one side detached from one of the haul ropes, the torque, T, induced by differing haul rope speeds will be relieved. In the form of detachment means shown in FIG. 3, detachment wheels 63 lift both sides of the load carrying unit so that all of grips 46–49 are detached from haul ropes 22 and 23 to thereby relieve any induced torque.

It should be noted that in the drawings, the distance to which detachment wheels 63 lift grips 46–49 from the haul ropes 22 and 23 has been exaggerated for clarity of illustration. Lifting by as little as 1/64th of an inch is sufficient to break the gripping and thereby relieve any buildup torque or skewing of the load carrying unit. In fact, lift need only be sufficient to permit sliding of the grips along the haul rope. In situations such as shown in FIG. 11 in which an auxiliary drive assembly is to be employed, the load carrying unit may desirably be lifted by more than a short distance to provide access to the haul rope for gripping and driving by the drive assembly.

In the most preferred form, the detachment wheels 63 are provided at haul rope support towers 66 along the tramway course which have been selected in their spacing to prevent destructive torque buildup in the load carrier units. It also will be apparent that the presence of a plurality of relatively rigid load carrying units attached between the haul ropes will tend to resist somewhat any tendency of one haul rope to be driven faster than the other.

In order to insure that load carrying unit 31 continues to travel at the same speed as the haul ropes when detached therefrom, it is preferable that detachment wheels 63 be mounted on a common shaft or axle 67 with haul rope support sheaves 68. If detachment wheels 63 and sheaves 68 are fixed for rotation to common axle 67 and are of the same diameter, the linear speed of the periphery 69 of the detachment wheels 63 will be substantially identical to the linear speed of haul ropes 22 and 23. As the load carrying unit is advanced by the haul ropes to detachment wheels 63, therefore, there will be minimal velocity difference during the detaching and reattaching process. Similarly, load carrying unit 31 will be conveyed by wheels 63, which act as auxiliary conveyance means, over the tower until the grips are to be reattached to the haul ropes at the same speed as the haul ropes. Reattachment, therefore, will not produce significant sliding by reason of the fact that the load carrying unit and haul ropes will be operating at the same speed. In FIG. 3, it will be seen that axle 67 is supported in bearings 71 carried by tower frame members 72.

It should be noted that the stepped structure of drive shoes 64 includes side walls 73 which act as lateral guide surfaces that can engage the sides 74 of guide wheels or tires 63 so as to maintain lateral alignment of the load carrying units during detachment, conveyance independently of the haul ropes, and reattachment.

It should also be noted that if the load carrying unit is detached from only one of the haul ropes, both the lateral alignment of the load carrying unit, and its forward velocity, will be controlled by the opposite haul rope which remains gripped by the undetached grip assemblies.

In the aerial tramway system of the present invention, it is preferable to return empty load carrying units on the lower stretch **22*b* and 23*b* of the two haul ropes. Moreover, this can easily be accomplished by inverting the load carrier units and using the opposite side of the wedging grip assemblies 46–49 to grip the lower stretch 22*b*, 23*b* of the haul ropes. One manner of effecting such an inversion will be described in more detail in connection with FIGS. 9 and 10**.

It is preferable to employ pairs of longitudinally spaced arms on each side of unit body 32 in order to enhance unit stability and to reduce the wedging forces required at each grip. It will be understood, however, that load carrying unit 31 also can be formed with a single arm extending from each side thereof or with a body which extends laterally to position a grip over each haul rope.

In FIGS. 6, 7 and 8 the inverted position of passenger carrier unit 31 as it passes over detachment means for relieving induced torque is shown. In FIGS. 6 through 8, detachment means in the form of detachment wheels or tires 81 engage drive shoe surfaces 82 which are in the form of flanges 83 affixed to the sides 36 and 37 of the load carrying unit body. As best may be seen in FIG. 7, the flanges 83 can take a generally arcuate form, having a radius which is selected to invert the load carrying units 31 at the end terminal assemblies, as will be described hereinafter. Surfaces 82 and arcuate flanges 83, however, extend sufficiently down below the apexes of the gripping wedge grooves so as to lift unit 31 upwardly off of the haul cables by a distance sufficient to unwedge the grip assemblies from the haul ropes. Again, in order to maintain conveyance of the load carrying unit at about the same speed as the haul ropes when the unit is detached from the haul ropes, it is preferable that detachment tires 81 and haul rope return sheaves 91 have approximately the same diameter and are mounted to a common shaft 92 for synchronous rotation.

As will be seen from comparing FIGS. 3 and 6, the detachment tires 81 can be of less width than tires 63 since the load carrying unit will be returned empty, and accordingly, will be relatively light in weight. It is also possible to form the peripheries 93 of the detachment wheels 81 with either a groove or a protrusion that mates with a similar groove or protrusion in drive shoe surfaces 82 to effect lateral alignment of the load carrying unit. As shown in the drawing, however, the sides 94 of the detachment tires simply engage the sides 36 and 37 of the load carrying unit to maintain lateral unit alignment with the haul ropes.

It should also be noted that the cable supporting sheaves 68 and 91, in the tramway system of the present invention, can be relatively wide and convergently sloped toward the cable receiving grooves 70 and 90. The gradual sloping of the haul rope support sheave surfaces on either side of the grooves 70 and 90 will insure that the haul rope will not crawl off the sheaves or migrate away from the support grooves.

Another form of detachment means for the aerial tramway of the present invention is to provide shoulders 96 on either side of sheave grooves 70 and 90 which engage the grips 46–49 on either side of the wedging grooves 51 and 56 so as to lift the grip assemblies away from the rope by means of sheave shoulders 96. This approach requires spacing of the sheaves and grip assemblies so that both grip assemblies on a side of load carrier unit are lifted at the same time off the haul ropes by rims 96. If rims 96 are used as the detachment mechanism, however, there is some tendency for the load carrier unit to bounce somewhat as it passes over the sheaves and is dropped back down on the ropes. In nonpassenger carrying applications, however, comfort of the ride of the load carrying unit over the sheaves is not critical. Moreover, a flange (not shown) similar to flange 83 can connect the pairs of grips and be engaged continuously by the haul rope sheave rims 96 so as to smooth the passage over the haul rope sheaves, and so as to eliminate the need for critical spacing in order to simultaneously lift both grip assemblies from the haul rope.

Another possible form of detachment means for the aerial tramway load carrying units of the present invention would be to form the grip assemblies themselves so that they will unwedge from gripping engagement with the haul ropes as the load carrying unit twists or is skewed about vertical axis 61. Such grip assemblies (not shown) would react to twisting produced about axis 61 from unequal haul rope speeds, by inducing a lifting force in the grip to produce unwedging of the grip from the haul rope. This might be accomplished, for example, by employing a grip with a greater angle $\Theta$ and by having the entry and exit of the gripping grooves 51 and 56 formed with surfaces in which the angle $\Theta$ increases even more than the wedge angle at the longitudinal center portion of the grooves. This will tend to produce an increased lifting force at the entry and exit upon twisting of the grip assembly. Such an approach would have the advantage of simplicity by reason of eliminating lifting wheels, but it would also have the disadvantage of having relief of the torque forces occur at unpredictable locations along the course of the tramway and requiring some significant twisting stress in the grip assemblies before the torque would be relieved.

The aerial tramway system of the present invention is particularly well suited for easy inversion of the load carrying units to effect dumping of the contents being transported. As may be seen in FIGS. 9 and 10, aerial tramway 21 can include an end terminal assembly, generally designated 101, in which the haul ropes are first detached from the grips by detachment tires 102, which lift the load carrying unit from the haul ropes. Once lifted from the haul ropes, haul ropes 22 and 23 can be laterally spread by guide sheaves 103 and 104 and thereafter aligned by sheave 106 with vertically oriented bullwheels 24 and 25, which are spaced apart by a distance greater than ends 107 of the carrier unit grips. This allows the carrier unit to pass between the vertical bullwheels in an unimpeded fashion.

Carrier units 31 are conveyed beyond guide sheaves 103 by a series of conveying wheels 108 which preferably engage the downwardly facing drive shoe 64 on the carrier unit body. Again, the surfaces 73 maintain lateral alignment of the load carrier unit between the pairs of driven conveying wheels 108.

Once load carrying unit 31 is conveyed to the vertical bullwheels, the bottom surface 109 of unit 31 is engaged by a drive drum 111 which may advantageously be mounted to shaft 28 on which the vertical bullwheels are mounted.

In order to control inversion of load carrying unit 31, a plurality of guide tires 112 is positioned in spaced concentric relationship to drum 111. It should be noted that the framework for such spacing, as well as the framework and drive motors for the various other drive wheels described herein have not been shown in the drawing for simplicity of illustration. Similarly, wheels 112 are provided in spaced pairs to engage shoe surfaces 82 on each side of the load carrying unit. Guide wheels 112 engage arcuate drive shoe surface 82 as load carrying unit 31 is advanced into contact with inversion drum 111. As can be seen in FIG. 9, the spacing of guide wheels 112 and the length of drive shoe surface 82 are such that, at all times during the inversion process which would be required to prevent loss of control of the load carrying unit, the unit is engaged at three contact points. Thus, drum 111 contacts the drive unit at point 116, guide wheel 112*a* contacts arcuate shoe 82 at point 117, and guide wheel 112*b* contacts arcuate shoe 82 at point 118. This three point contact proceeds around the drum until unit 31 is inverted and rests entirely on guide and driving tires 119, as shown in FIG. 9 at the bottom left hand position of unit 31. Once the load carrying unit is inverted, it can be supported on driven wheels 119 by gravity, and while there will be some rocking or bouncing as the unit moves from wheel-to-wheel on arcuate surface 82, the comfort of motion is not critical in a mining application.

Driven wheels 119 gradually convey the detached load carrying unit 31 upwardly until the grip assemblies have been raised above the lower stretch 22*b* and 23*b* of the return haul ropes, which must occur prior to bending of the haul ropes by sheaves 106, 104 and 103 into alignment with the return cable support sheaves 91. Once the grips 46–49 are above the return stretches 22*b* and 23*b*, the detachment wheels can terminate and allow the grips to wedge back down on top of the return stretches for conveyance with the haul ropes.

It will be apparent that arcuate surface 82 is most advantageously formed with a radius which is concentric with drum 111 and the centers of wheels 112. As shown in the drawing, the lower surface 115 is not engaged or used during inversion. This surface could be a planar surface, but an alternative inversion assembly can be employed in which a second set of guide wheels is used to engage surface 115 instead of using drum 111 to engage surface 109.

It is generally preferred in the aerial tramway system of the present invention to have the loaded carrier units advanced on the upper stretches 22*a* and 22*b* of the haul ropes and the inverted empty load carrying units return on the lower stretches 22*b*, 23*b* of the haul ropes. This makes loading, for example, by an overshoot conveyor at one end of the tramway assembly, relatively easy and facilitates dumping at the other end, as shown in FIGS. 9 and 10. It is possible to reverse the loaded and unloaded stretches, but loading and unloading at the end terminals is made more complex.

One of the substantial problems which is present in aerial tramways of substantial length is that the friction losses in the haul ropes over the support towers begin to accumulate significantly. While a single bullwheel set can be used to drive haul ropes of the length typically found in passenger carrier applications, in the much longer ore conveying applications, rolling friction losses on the various support towers cause the rope tension to have to be increased substantially, with attendant increase in rope size. It should be noted throughout that the expression "rope" actually refers to a steel, stranded cable in virtually all installations.

Figure 12:
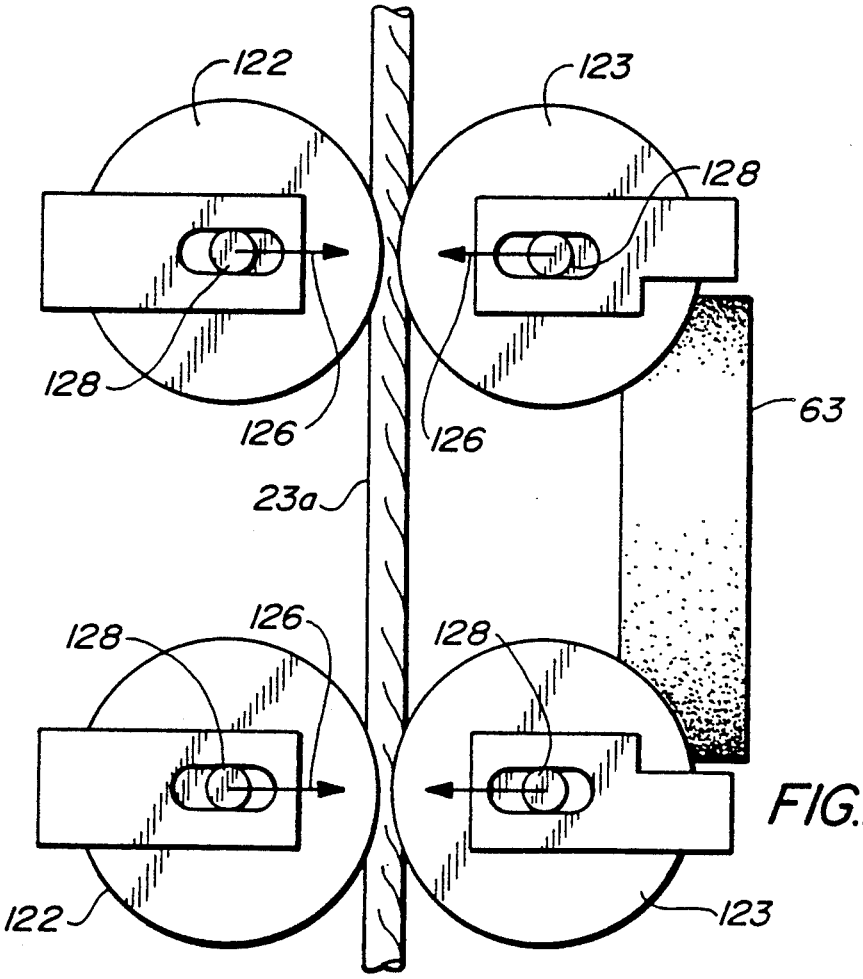
FIG. 12 is a top plan view of the assembly of FIG. 11 with the load carrying unit removed.

One advantage of the aerial tramway system of the present invention is that lifting of the load carrying units in order to relieve induced torque also affords access to the haul ropes for primary or auxiliary driving. Thus, as best may be seen in FIGS. 11 and 12, selected towers along the course of the aerial tramway can be provided with auxiliary driving assemblies, generally designated 121, which engage the haul ropes when and during the length that the load carrier units are detached from the haul ropes. As schematically illustrated in FIGS. 11 and 12, haul rope 23*a* is gripped between a pair of drive sheaves 122 and 123, which are resiliently biased towards each other and toward the haul rope, for example, by springs 124. The biasing, as indicated in FIG. 12 by arrows 126, causes the auxiliary drive sheaves 123 and 124 to squeeze the haul rope. Drive motors 127 can be coupled through shafts 128 to tower the respective sheaves 123 and 124, which can be lined with a high friction material 129 to effect driving engagement with haul rope 23*a*. The actual mounting of the biasing springs and framework for support of auxiliary drive sheaves 123 and 124 can vary greatly, but the detachment tires 63 must lift the load carrying unit arms 41–44 sufficiently above the haul ropes to clear the auxiliary drive sheaves and their supporting framework.

Figure 13:
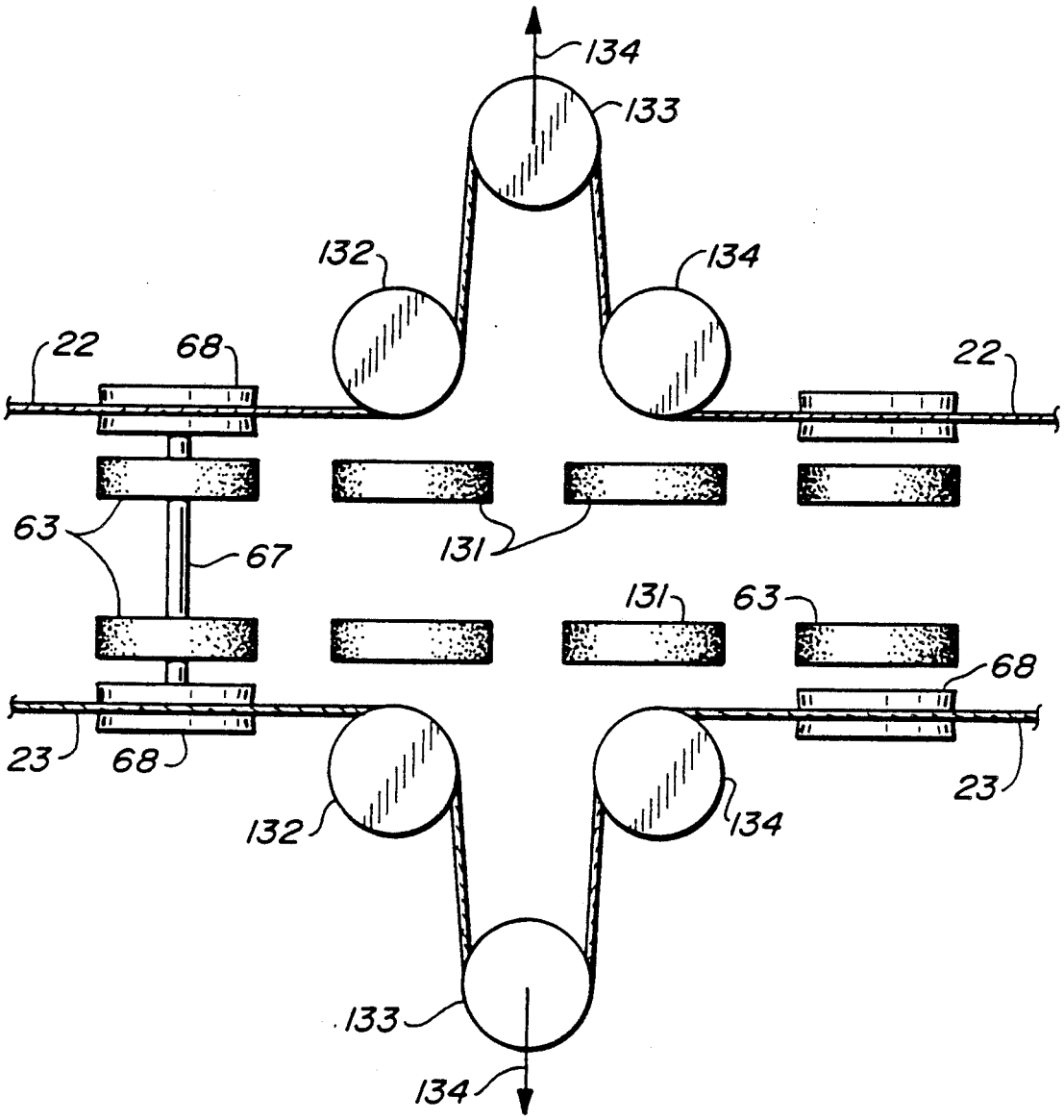
FIG. 13 is a top plan schematic view of a rope tension adjustment assembly suitable for us with the aerial tramway system of FIG. 1.

In a similar fashion, aerial tramway system 21 is well suited to the provision of rope tension adjustment means or a primary drive wheel remote of the end terminals, as illustrated in FIG. 13. Haul ropes 22 and 23 can be seen to be mounted on support sheaves 68 with associated carrier unit detachment wheels or tires 63. Once the carrying unit is detached from the haul ropes, it is conveyed along the tramway course by driven tires or wheels 131 while the haul ropes are guided in a lateral direction by haul rope engaging sheaves 132, 133 and 134. In order to effect rope tensioning or rope driving, or both, the middle sheaves 133 can be mounted for outward displacement, as indicated by arrows 134, and powered or driven. Such displacement can be resiliently biased or pneumatically controlled and subject to selective adjustment. Thus, the rope tensioning or driving assembly can engage the haul rope in a horizontally extending plane away from the nominal path of the same to effect tensioning by displacement of a movable sheave laterally relative to the nominal haul rope path.

What is claimed is:

1. In an aerial tramway having a pair of side-by-side, substantially parallel, movable haul ropes extending over a course; and at least one load carrying unit attached to both said haul ropes for advancement with said haul ropes; the improvement in said aerial tramway comprising:

a plurality of detachment means positioned periodically along said course, said detachment means formed for and cooperating with said load carrying means to effect detaching of said load carrier unit from at least one of said haul ropes sufficiently to relieve torque induced in said load carrying unit due to differences in haul rope speeds.

2. The aerial tramway as defined in claim 1 wherein, said load carrying unit is attached to said haul ropes by a plurality of detachable grip assemblies, and said detachment means detach all said gripping assemblies from said haul ropes to relieve induced torque.

3. The aerial tramway as defined in claim 2, and conveying means positioned proximate said detachment means, said conveying means engaging said load carrying unit and conveying said load carrying unit along said course when said grip assemblies are detached from said haul ropes.

4. The aerial tramway assembly as defined in claim 2 wherein, said detachment means further cooperatively disengages from said load carrying means to effect reattachment of said load carrying unit to both of said haul ropes.

5. The aerial tramway as defined in claim 1 wherein, said load carrying unit is attached to said haul ropes by a detachable grip assembly formed to detachably wedge against said one of said haul ropes to effect gripping thereof, and said detachment means displaces said detachable assembly in a direction opposed to wedging against said one of said haul ropes to effect detachment.

6. The aerial tramway as defined in claim 1, and a plurality of haul rope support towers positioned intermediate ends of said course and movably supporting said haul ropes; and said detachment means is positioned on at least some of said haul rope support towers.

7. The aerial tramway as defined in claim 1 wherein, said load carrying unit has four grip assemblies mounted thereon, with two longitudinally spaced grip assemblies positioned on each side of said load carrying unit for gripping each of said haul ropes at two longitudinally spaced apart positions thereon.

8. The aerial tramway as defined in claim 7 wherein, said grip assemblies each are detachable from said haul ropes and have no parts requiring movement to effect attachment to or detachment from said haul ropes.

9. The aerial tramway as defined in claim 8 wherein, said grip assemblies each are formed and oriented for gravity wedging down against said haul ropes to effect gripping of the same.

10. The aerial tramway as defined in claim 9 wherein, said detachment means lifts said grip assemblies vertically from said haul rope to effect detachment.

11. The aerial tramway as defined in claim 8 wherein, said grip assemblies are formed for gripping said haul ropes when said load carrying unit is positioned upright for carrying a load and when said load carrying unit is inverted.

12. The aerial tramway as defined in claim 11 wherein, said grip assemblies each are formed for gravity wedging into gripping engagement with said haul rope when said load carrying unit is upright and when said load carrying unit is inverted.

13. The aerial tramway as defined in claim 1 wherein, said load carrying unit is attached to said haul ropes by grip assemblies each formed for detachment from and gripping of said haul ropes when said load carrying unit is upright for carrying a load and when said load carrying unit is inverted.

14. The aerial tramway as defined in claim 1 wherein, said load carrying unit includes drive shoe surface means mounted thereto and oriented for conveying of said load carrying unit along said course.

15. The aerial tramway as defined in claim 14 wherein, said load carrying unit has grip assemblies each of which are formed for detachable gripping of said haul ropes while said load carrying unit is in an upright orientation and detachable gripping of said haul rope when said load carrying unit is in an inverted orientation, and said drive shoe surface means is oriented for cooperation with said detachment means to effect detachment of said grip assemblies and is oriented for conveying said load carrying means in both said upright orientation and said inverted orientation.

16. The aerial tramway as defined in claim 15, and conveying means positioned proximate said detachment means and conveying said load carrying upon detachment of said grip assemblies from said haul ropes.

17. The aerial tramway as defined in claim 1 wherein, said detachment means is provided by conveying means displaceably engaging one of said load carrying unit and said haul ropes and relatively displacing the same to effect detachment, and said conveying means further conveying said load carrying unit along said course while load conveying unit is detached from said one of said haul ropes.

18. The aerial tramway as defined in claim 17 wherein, said conveying means is provided by a plurality of detachment wheels having substantially the same peripheral velocity as the velocity of said haul ropes.

19. The aerial tramway as defined in claim 18 wherein, said haul ropes are supported for movement on support sheaves, and said detachment wheels are substantially the same diameter as said support sheaves and mounted for rotation on common axles with said support sheaves.

20. The aerial tramway as defined in claim 14, and lateral guide means provided on said load carrying unit and formed for cooperative engagement with conveying means for aligned conveying of said load carrying means along said course when detached from said haul ropes.

21. The aerial tramway as defined in claim 20 wherein, said drive shoe means and said lateral guide means are provided by longitudinally extending step structures in opposed sides of said load carrying means.

22. The aerial tramway as defined in claim 1 wherein, said load carrying unit is formed with inversion guide means; and an inversion assembly positioned proximate said haul ropes and cooperatively engaging said load carrying unit to invert said load carrying unit to effect emptying of the same.

23. The aerial tramway as defined in claim 22 wherein, said inversion guide means is provided by a pair of arcuate surfaces extending longitudinally along said load carrying unit on opposite sides thereof, and said inversion assembly includes a plurality of guide wheels positioned to engage said arcuate surfaces during inversion of said load carrying unit.

24. The aerial tramway as defined in claim 23 wherein, said arcuate surface is upwardly facing; and said inversion assembly includes a drive drum engaging a downwardly facing surface on said load carrying unit, and at least two of said guide wheels engage said arcuate surface during inversion of said load carrying unit.

25. The aerial tramway as defined in claim 24 wherein, said drive drum is mounted for rotation between two vertically oriented bullwheels on a common shaft therewith.

26. An aerial tramway comprising:

a pair of endless-loop, side-by-side, substantially parallel, movable haul ropes oriented in substantially vertical planes and extending over a course;

a plurality of load carrying units detachably mounted between an upper stretch of said haul ropes by grip assemblies for advancement with said haul ropes in one direction;

a plurality of load carrying units detachably mounted to a lower stretch of said haul ropes by grip assemblies for advancement with said haul ropes in an opposite direction; and each of said load carrying units including arms extending laterally from opposite sides of said load carrying unit with a grip assembly being mounted on each of said arms.

27. The aerial tramway as defined in claim 26 wherein, each load carrying unit is formed with a pair of arms extending outwardly from each side thereof, said arms being longitudinally spaced apart along said load carrying unit and each of said arms having a detachable grip assembly mounted thereto.

28. The aerial tramway as defined in claim 27 wherein, said grip assemblies are each formed for detachable gripping of said haul ropes when said load carrying unit is in an upright orientation and when said load carrying unit is in an inverted position.

29. The aerial tramway as defined in claim 27 wherein, said grip assemblies are each formed for gravity induced wedging against said haul ropes to effect gripping and attachment of said load carrying unit to said haul ropes.

30. The aerial tramway as defined in claim 26 wherein, said haul ropes are supported for movement by opposed end terminal assemblies and a plurality of intermediate haul rope support towers; and detachment means provided at a plurality of said support towers to engage and detach said load carrying units from at least one of said haul ropes sufficiently to relieve torque resulting from differences in speed of said haul ropes.

31. In an aerial tramway having at least one haul rope supported for movement between end terminals over a course, at least one load carrying unit detachably mounted to said haul rope by a detachable grip assembly, and drive means coupled to advance said haul rope along said course, the improvement in said aerial tramway comprising:

detachment means positioned intermediate said end terminals and cooperating with said detachable grip assembly to detach said load carrying unit from said haul rope and thereafter reattach said load carrying unit to said haul rope; and said drive means including a rope engaging drive assembly engaging and driving said haul rope at said length of said course while said load carrying unit is detached from said haul rope.

32. The aerial tramway as defined in claim 31, and auxiliary conveying means positioned proximate said detachment means and conveying said load carrying unit along said length of said course while said load carrying unit is detached from said haul rope.

33. The aerial tramway as defined in claim 31 wherein, said aerial tramway includes a pair of endlessloop haul ropes mounted in side-by-side substantially parallel relation, said load carrying units are mounted between said haul ropes by grip assemblies including at least one detachable grip assembly.

34. The aerial tramway as defined in claim 31 wherein, said drive means include a pair of drive sheaves biased into engagement with opposite sides of one of said haul ropes to drive said haul rope.

35. The aerial tramway as defined in claim 34 wherein, said detachment means lifts said grip assembly vertically relative to said haul rope, and said drive sheaves are substantially horizontally oriented to engage opposite sides of said haul rope.

36. The aerial tramway as defined in claim 31 wherein, said detachment means lifts said grip assembly vertically relative to said haul rope, and rope tension adjustment sheave assembly engaging said haul rope over said length and oriented in a horizontally extending plane.

37. A method of conveying a load carrying unit in an aerial tramway including the steps of attaching said load carrying unit to a pair of haul ropes, and advancing said haul ropes over a course to advance said load carrying unit therewith, wherein the improvement in said method comprises the step of:

periodically, over the length of said course, detaching said load carrying unit from at least one of said haul ropes to relieve torque induced in said load carrying unit as a result of differing haul rope speeds; and after said detaching step, reattaching said carrier unit to said haul ropes.

38. The method as defined in claim 37 wherein, said detaching step is accomplished by detaching said load carrying unit from both of said haul ropes.

39. The method as defined in claim 37, and the step of:

conveying said load carrying unit along said course at about the speed of advancement of said haul rope during the time of detachment of said load carrying unit from said haul rope.

40. The method as defined in claim 37, and the step of:

at said length of detachment of said load carrying unit, applying a driving force to said haul rope.

41. The method as defined in claim 37 wherein, said attaching step is accomplished by attaching a plurality of load carrying units in an upright orientation for carrying of a load to a pair of upper stretches of a pair of side-by-side endless loop haul ropes oriented in substantially vertical, substantially parallel planes for advancing in one direction along said course, and said attaching step is further accomplished by attaching a plurality of load carrying units in an inverted orientation to a lower stretch of said haul ropes for advancing in an opposite direction along said course.

42. A method of driving a load carrying unit attached to a haul rope over a course comprising the steps of:

intermediate ends of said course, detaching said load carrying unit from said haul rope;

conveying said load carrying unit over a length of said course while detached from said haul rope; and engaging said haul rope at said length of said course with drive means and applying a driving force to said haul rope with said drive means.

43. A method of driving a load carrying unit as defined in claim 42 wherein, said step of engaging said haul rope and applying a driving force is accomplished by engaging said haul rope by two drive wheels biased toward each other.

* * * * *